United States Patent [19]

Berland

[11] 4,142,072

[45] Feb. 27, 1979

[54] DIRECTIONAL/OMNIDIRECTIONAL HEARING AID MICROPHONE WITH SUPPORT

[75] Inventor: Ole Berland, Horsholm, Denmark

[73] Assignee: Oticon Electronics A/S, Copenhagen, Denmark

[21] Appl. No.: 832,187

[22] Filed: Sep. 12, 1977

[30] Foreign Application Priority Data

Nov. 29, 1976 [GB] United Kingdom ..... 49605/76

[51] Int. Cl.[2] ..... H04R 1/38; H04R 25/00

[52] U.S. Cl. ..... 179/107 FD; 179/121 D

[58] Field of Search ..... 179/107 FD, 121 D

[56] References Cited

U.S. PATENT DOCUMENTS

| | | | |
|---|---|---|---|
| 3,870,820 | 3/1975 | Suzuki et al. | 179/1DM |
| 3,909,556 | 9/1975 | Johanson | 179/107 FD |
| 4,051,330 | 9/1977 | Cole | 179/107 FD |

*Primary Examiner*—George G. Stellar
*Attorney, Agent, or Firm*—Bucknam and Archer

[57] ABSTRACT

A hearing aid is described which comprises an outer front opening and an outer rear opening which are connectable to the respective sides of a membrane in a microphone within the housing of the hearing aid for directional use, and mechanical means for closing the outer rear opening for omnidirectional use, in which said closing means is formed and arranged so as in the closing position thereof to establish a narrow acoustically dimensioned sound passageway from the outer opening not closed to the side of the membrane corresponding to the closed outer opening. According to one embodiment, the mechanical closing means is a slide displaceable along the housing wall in which the opening to be closed is formed, and in which the narrow acoustically dimensioned passageway is an elongated recess in the displaceable slide.

2 Claims, 5 Drawing Figures

DIRECTIONAL/OMNIDIRECTIONAL HEARING AID MICROPHONE WITH SUPPORT

Figure 1:
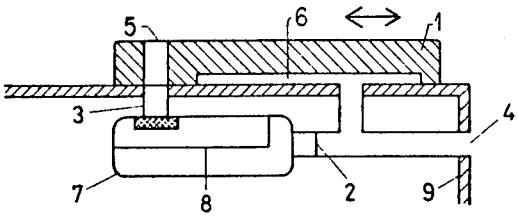

The present invention relates to hearing aids with directional microphones the directional effect of which may be changed stepwise or continuously, especially in which the directional effect may be completely eliminated, i.e. where the directional pattern may be changed from for instance cardioid form corresponding to directional reception to spheric form corresponding to omnidirectional reception.

Hearing aids of this type may include two microphones one of which is for omnidirectional use and both of which are for directional use. It is essential that the frequency characteristics by directional and omnidirectional use are equal. This may be obtained by appropriately adjusting the amplifier of the hearing aid.

The best solution proposed hitherto is disclosed in German Published Specification No. 2 400 666 relating to hearing aids with two outer microphone openings of which only one is used for omnidirectional reception. The German specification also discloses a method of avoiding any change of frequency characteristic when the hearing aid is shifted from directional effect to omnidirectional effect. This is obtained by incorporating in the hearing aid in connection with the microphone a special acoustic impedance, the acoustic data of which may vary in course of time, for instance due to moisture and temperature differences.

The special acoustic impedance is used in connection with a particular directional microphone and both will complicate the hearing aid and make it more expensive.

When a standard directional microphone is used in the known hearing aid, the cavities surrounding the microphone are forming part of the acoustical system which makes the microphone sensitive to case noise, which means that undesirable acoustic signals are received when the hearing aid is touched, for instance by fingers.

The object of the present invention is to improve the known hearing aid by providing a hearing aid having the important advantages of the known hearing aid, viz. a perfect omnidirectional reception by using only one outer microphone opening in the omnidirectional position, and having a frequency characteristic which remains unchanged when shifting from omnidirectional to directional reception, but not having the aforesaid deficiencies of the known hearing aid.

In a hearing aid with an outer front opening and an outer rear opening which are connectable to the respective sides of a membrane in a microphone within the housing of the hearing aid for directional use, and with mechanical means for closing the outer rear opening for omnidirectional use, this is obtained by said closing means being formed and arranged so as in the closing position thereof to establish a narrow acoustically dimensioned sound passageway from the outer opening not closed to the side of the membrane corresponding to the closed outer opening.

If the mechanical closing means of the hearing aid in a manner known per se is a slide displaceable along the housing wall in which the opening to be closed is formed, the narrow acoustically dimensioned passageway may according to the invention be an elongated recess in the displaceable slide, which is a very simple and effective solution.

The closing slide is preferably provided with an opening in register with the opening in said housing wall in the opening position of the slide.

The microphones of hearing aids are usually resiliently suspended within the housing by means of springs or elastic hose connections.

When the rear opening of the hearing aid is closed, a volume of air will remain between the closed opening and the microphone. This air volume may give rise to an undesirable pumping effect which may actuate the microphone and cause noise effects. This is a special problem in the hearing aid according to the invention, which may be solved by providing the microphone with a rigid support, preferably an edge support, at a place opposite the rear port of the microphone.

Figure 2:
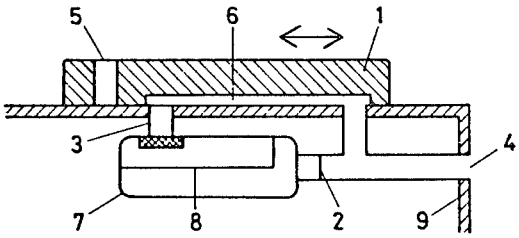
Figure 3:
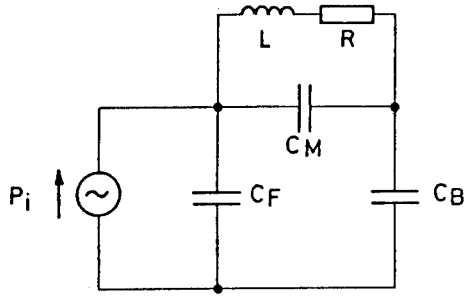
Figure 4:
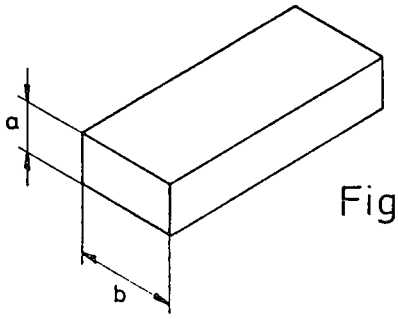
Figure 5:
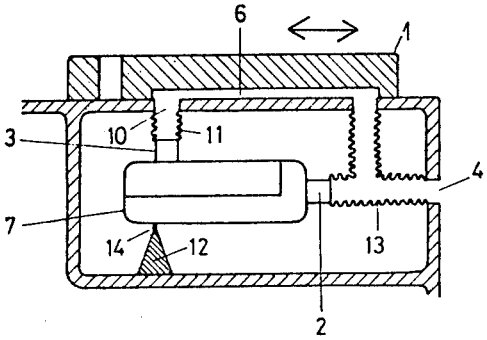

The invention will be more fully described with reference to the drawings, in which FIG. 1 shows a sectional view of part of a hearing aid according to the invention with the slide positioned for directional reception, FIG. 2 shows the same with the slide positioned for omnidirectional reception, FIG. 3 shows a simplified acoustic equivalence diagram for a hearing aid according to the invention with the slide closing the rear opening, FIG. 4 shows schematically the narrow acoustically dimensioned sound passageway of the hearing aid according to the invention, and FIG. 5 shows a partial section of the hearing aid illustrating how the microphone is supported within the housing.

In FIGS. 1 and 2, numeral 7 designates a standard directional microphone with a membrane 8 mounted, preferably resiliently suspended, in the housing 9. The microphone 7 is provided with a front sound port 2 and a rear sound port 3 which, as shown in FIG. 2, may be connected through a narrow sound passageway 6 formed as an elongated recess in a slide 1 displaceable along the upper wall of the housing 9.

From FIGS. 1 and 2 it will appear that the narrow sound passageway 6 is only connecting the sound ports 2 and 3 in the position for omnidirectional reception shown in FIG. 2. The slide 1 is provided with an opening 5 which in the position of the slide shown in FIG. 1 is in register with the rear sound port 3. The opening 5 is the outer rear opening of the hearing aid, the outer front opening of which is designated 4.

From FIG. 2 it will appear that in the position of the slide 1 the cavity between the narrow passageway 6 and the upper side of the membrane 8 is minimized to reduce noise problems caused by contact with the hearing aid.

Referring now to FIG. 3, $P_i$ is the sound pressure at the microphone front sound port, $C_F$ is the front cavity compliance, $C_M$ is the membrane compliance, $C_B$ is the rear cavity compliance, L is the mass of air in the sound passageway, and R is the loss due to the sound pressure in the sound passageway.

The acoustic values L and R for the sound passageway according to the invention depend on the dimensions of the cross section of the passageway, vide FIG. 4 wherein these dimensions are a and b:

$$R = \alpha/(a^3b) \qquad L = \beta/(ab)$$

where $\alpha$ and $\beta$ are constants. It appears that by appropriately selecting the proportion a/b it is possible to determine the relation between R and L and thus to give the total acoustic impedance of the passageway a certain optimal value keeping the frequency characteristic unchanged whether the microphone system is working with or without directional reception.

In the embodiment shown in FIG. 5 the microphone 7 is resiliently suspended by means of an elastic hose connection 11 between the rear sound port 3 and the passageway 6, and an elastic hose connection 13 between the front sound port 2 and the front opening 4 and the passageway 6.

Owing to the small movements of the resiliently suspended microphone, the small air volume 10 above the rear sound port 3 will be subject to an undesirable pumping effect. This effect is eliminated by rigidly supporting the rear end of the microphone by means of an edge support 12. In spite of this support, the microphone 7 is still resiliently suspended as the microphone is movable about the line 14 of the edge support 12.

The hearing aid according to the invention may be of the behind-the-ear type or hearing aid spectacles.

What we claim is:

1. A hearing aid with an outer front opening and an outer rear opening which are connectable to the respective sides of a membrane in a microphone within the housing of the hearing aid for directional use, and with mechanical means for closing the outer rear opening for omnidirectional use, in which said closing means is formed and arranged so as in the closing position thereof to establish a narrow acoustically dimensioned sound passageway from the outer opening not closed to the side of the membrane corresponding to the closed outer opening, and wherein the microphone is resiliently suspended within the housing and the microphone is provided with a rigid support at a place opposite the rear port of the microphone.

2. A hearing aid according to claim 1 in which the rigid support is an edge support.

* * * * *